United States Patent [19]

Robbins, III et al.

[11] Patent Number: 4,947,523

[45] Date of Patent: Aug. 14, 1990

[54] BAG CLOSURE DEVICES

[75] Inventors: Edward S. Robbins, III, 459 N. Ct., Florence, Ala. 35630; Theodore J. Onocki, Westerville, Ohio

[73] Assignee: Edward S. Robbins, III, Florence, Ala.

[21] Appl. No.: 403,464

[22] Filed: Sep. 5, 1989

Related U.S. Application Data

[63] Continuation-in-part of Ser. No. 241,208, Sep. 7, 1988, abandoned, and a continuation-in-part of Ser. No. 352,463, May 16, 1989, abandoned.

[51] Int. Cl.[5] ..... B65D 77/10

[52] U.S. Cl. ..... 24/30.5 R; 24/487; 24/543; 24/557; 292/325; 383/25; 383/71

[58] Field of Search ..... 24/30.5 R, 30.5 P, 30.5 L, 24/543, 487, 557, 16 PB; 383/25, 29, 71; 292/321, 325, 318; 224/217, 250, 165; 294/149, 31.2, 137

[56] References Cited

U.S. PATENT DOCUMENTS

| | | |
|---|---|---|
| 1,530,342 | 3/1925 | Barber . |
| 3,112,542 | 12/1963 | Brunson . |
| 3,259,302 | 7/1966 | Rocchisani . |
| 3,462,068 | 8/1969 | Suominen . |
| 3,543,977 | 12/1970 | Lockridge . |
| 3,548,906 | 12/1970 | Murphy . |
| 3,692,218 | 9/1972 | Friedman . |
| 3,760,463 | 9/1973 | Schneider . |
| 3,818,553 | 6/1974 | Paramenter . |
| 3,912,140 | 10/1975 | Franges . |
| 4,112,541 | 9/1978 | Tetradis . |
| 4,128,220 | 12/1978 | McNeel . |
| 4,200,962 | 5/1980 | Niedecker . |
| 4,275,485 | 6/1981 | Hutchison . |
| 4,506,415 | 3/1985 | Swift . |
| 4,551,888 | 11/1985 | Beecher . |
| 4,656,697 | 4/1987 | Naslund . |
| 4,663,807 | 5/1987 | Bozzo . |
| 4,742,601 | 5/1988 | Furutsu . |

FOREIGN PATENT DOCUMENTS

| | | |
|---|---|---|
| 963214 | 7/1950 | France . |
| 1477737 | 4/1967 | France . |

*Primary Examiner*—James R. Brittain

*Attorney, Agent, or Firm*—Nixon & Vanderhye

[57] ABSTRACT

A bag closure device includes a handle member, a clasp member connected at one of its ends to the handle member and having an opposite free end capable of being removably coupled to the handle member. Structure is provided which beneficially compresses, and hence closes, a portion of flexible bag therebetween. According to one embodiment, such structure may be in the form of a truncated V-shaped member associated with the handle member which compresses a region of the bag against a V-shaped trough associated with the clasp member. In another embodiment, such structure includes a circumferential boss segment which compresses the bag portion against an interior surface of an axially flexible strap member. In either embodiment, the captured bag is effectively prevented from slipping under its own weight during transport of the bag via the bag closure device. Structures are also provided so as to prevent relative slippage between the clasp and handle members when in their closed condition so as to preclude substantially inadvertent uncoupling thereof by virtue of such relative slippage.

44 Claims, 6 Drawing Sheets

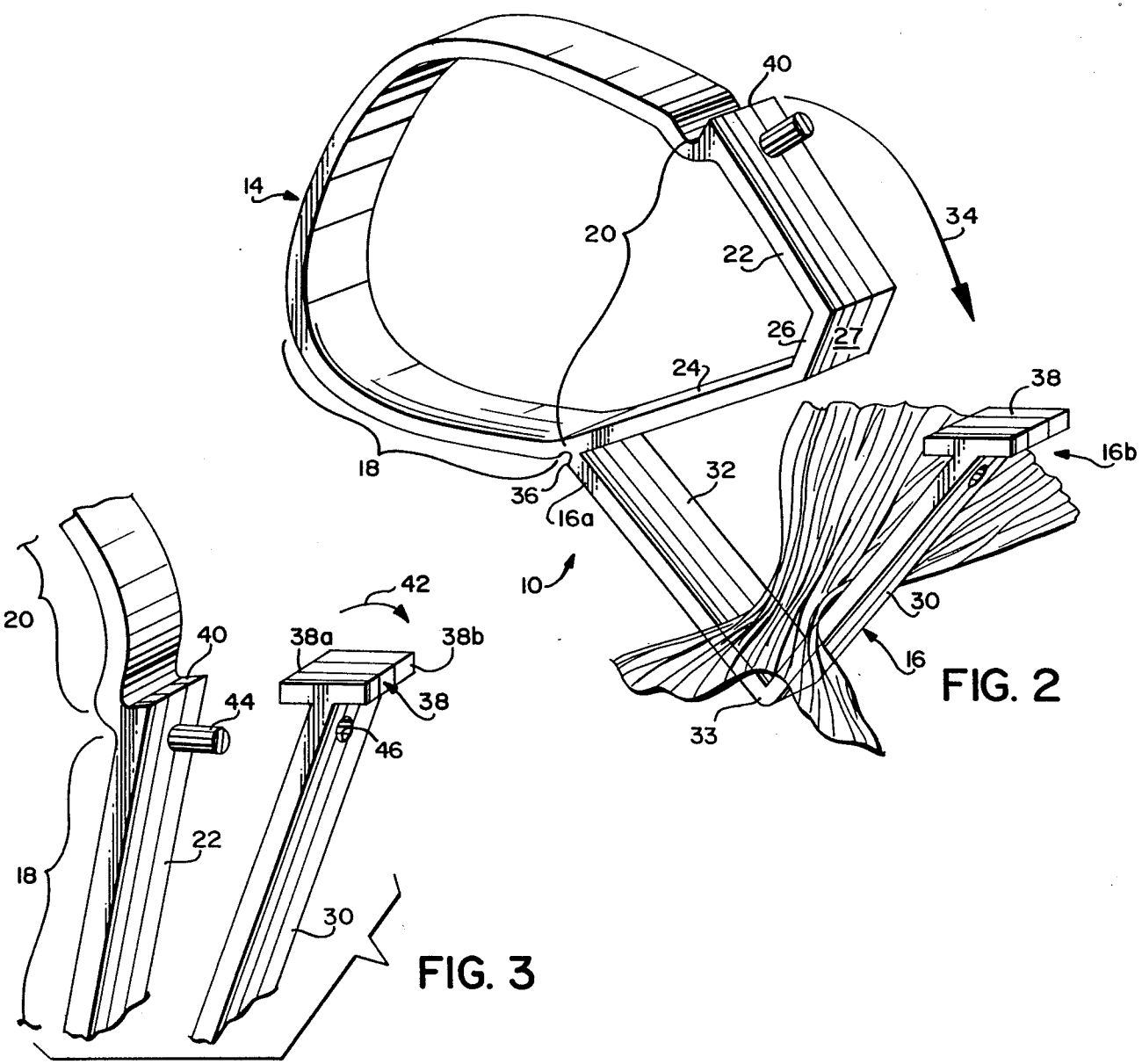
FIG. 2
FIG. 3
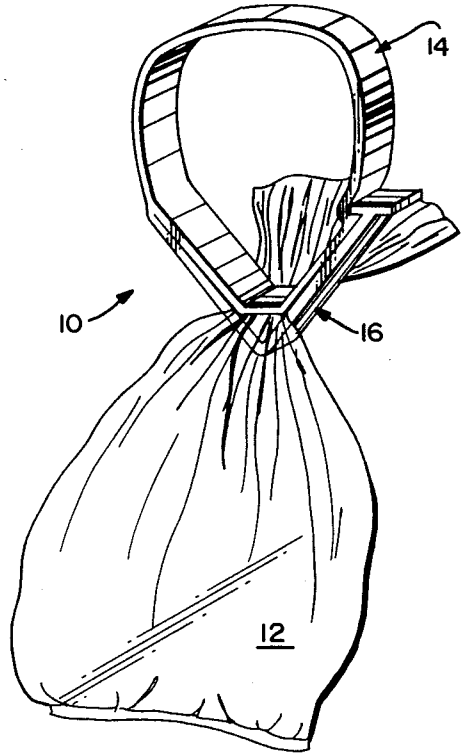
FIG. 1

BAG CLOSURE DEVICES

CROSS-REFERENCE TO RELATED APPLICATIONS

This is a continuation-in part application of commonly owned and copending U.S. Patent Application Ser. No. 07/241,208 filed Sept. 7, 1988, entitled "Bag Closure Devices" (now abandoned), and No. 07/352,463 filed May 16, 1989, entitled "Bag Closure Devices" (now abandoned), and is related to commonly owned, copending U.S. Patent Application Ser. No. 07/141,042 filed Jan. 5, 1988, now U.S. Pat. No. 4,871,264, entitled "Bag Closure Device and Methods of Fabricating the Same", and commonly owned U.S. Pat. No. 4,835,820 entitled "Bag Closure Device", the entire contents of each of the above-cited applications and patent being expressly incorporated hereinto by reference.

FIELD OF THE INVENTION

This invention relates to devices of the type used to close flexible bags. In preferred forms, the invention is embodied in a bag closure device having a handle member, a clasp member pivotally connected at one of its ends to the handle member and having a free end which is capable of being removably coupled to the handle member. The handle member and clasp member collectively provide structure which compresses, and hence closes, a portion of a flexible bag therebetween.

BACKGROUND AND SUMMARY OF THE INVENTION

It is oftentimes desirable to reclose a bag once it has been opened, particularly if the bag contains a food product which would spoil or become stale if the bag was allowed to remain open. In this regard, a variety of devices have been proposed in the past so as to accomplish bag-closure functions, as is evidenced from the following non-exhaustive listing of prior-issued U.S. Pat. Nos.:

| U.S. Pat. No. | Patentee | Issue Date |
|---|---|---|
| 3,112,542 | Brunson | Dec. 3, 1963 |
| 3,259,302 | Rocchisani | July 5, 1966 |
| 3,818,553 | Parmenter | Jun. 25, 1974 |
| 3,548,906 | Murphy | Dec. 22, 1970 |
| 3,692,218 | Friedman | Sep. 19, 1972 |
| 4,112,541 | Tetradis | Sep. 12, 1978 |
| 3,760,463 | Schneider | Sep. 25, 1973 |
| 3,912,140 | Franges | Oct. 14, 1975 |
| 4,200,962 | Niedecker | May 6, 1980 |
| 4,275,485 | Hutchison | Jun. 30, 1981 |
| 4,663,807 | Bozzo | May 12, 1987 |
| 3,462,068 | Suominen | Aug. 19, 1969 |

As the reader will undoubtedly appreciate from even a cursory review of the above-cited prior-issued U.S. Patents, there still exists a need in this art for improvements in bag closure devices. Specifically, it would be desirable if an improved bag closure device was provided which included a unitary handle and bag-closure clasp which cooperate so as to effectively close the open end of a flexible bag without the bag slipping from the device during its transport by a user. It is towards attaining these needs that the present invention is directed.

According to the present invention, a bag-closure device is provided which includes a generally annular handle member and an elongate clasp member. The clasp member is attached at one of its ends to a side of the handle member so as to allow for relative movements of the clasp and handle members between open and closed positions. The other, free end of the clasp member and a portion of the handle member collectively include the means by which the clasp and handle members may be removably coupled to one another when the clasp member is in its closed position so as to capture, and thus close, a flexible bag portion therebetween.

Important to the present invention, means are provided so as to compress the flexible bag portion captured between the handle and clasp members. According to one embodiment, the lower portion of the handle member includes a truncated surface which defines a bounded region together with a V-shaped portion of the clasp member. The flexible bag may thus be placed in a gathered condition in the V-shaped portion of the clasp member, with the truncated surface compressing it when the clasp is in its closed position. According to another embodiment of the invention, an elongate bearing lug protrudes from a circumferential segment of the handle member's exterior surface, the bearing lug thereby effectively compressing (and hence capturing) the flexible bag portion between it and an interior surface of the clasp member when in a closed position.

The means which couple the clasp and handle members of this invention one to the other preferably includes structure which precludes lateral slippage between the clasp and handle members so as to thereby minimize (if not prevent) inadvertent disengagement, and hence uncoupling, thereof. One form of the slippage prevention means according to the present invention is a stake which extends from one of the clasp and handle members and an aperture defined in a corresponding position by the other of the clasp and handle members. Thus, when the clasp and handle members are coupled to one another, the stake will mate with the defined aperture to prevent later slippage from occurring. Another structural form of the invention which performs functions equivalent to the stake and aperture arrangement is an elongate tongue and groove which, when mated, prevent lateral slippage from occurring as between the clasp and handle members.

Other embodiments of the slippage preventing means include structure which forms generally V-shaped (as viewed in cross-section) outwardly projecting surfaces along a predetermined circumferential extent of the handle member. The clasp member will thus be provided with a corresponding V-shaped (as viewed in cross-section) recessed surface which mates with the outwardly projecting surfaces of the handle member.

According to another embodiment of the slippage preventing means according to this invention, circumferentially extending, and outwardly projecting, ribs are provided on the handle member. Recessed channels are also provided and are sized and configured to receive the ribs when the clasp member is in a closed condition.

In yet another embodiment, the slippage preventing means of this invention includes at least one pair of circumferentially spaced-apart flanges formed on a lateral edge of the handle member. At least one retaining flange is formed on a corresponding lateral edge of the clasp member and is thus adapted to being positioned between the spaced-apart flanges so as to bear against the lateral edge of the handle member on which the spaced-apart flanges are formed. In such a manner, relative lateral slippage between the handle member and the clasp member is minimized.

These, and other aspects and advantages of this invention will become more clear after careful consideration is given to the detailed description of the preferred exemplary embodiments thereof which follows.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 1 is a perspective view of one embodiment of a bag closure device according to the present invention shown in its closed position;

FIG. 2 an enlarged perspective view of the bag closure device shown in FIG. 1 but depicted in its open position;

FIG. 3 is a detailed perspective view of one possible coupling means which may be employed with the bag closure device shown in FIGS. 1 and 2;

FIGS. 4 and 5 each show other possible coupling means which may be employed by the bag closure devices of this invention;

FIGS. 14A and 14B are each cross-sectional views taken along lines 14A—14A and 14B—14B in FIG. 13;

DETAILED DESCRIPTION OF THE PREFERRED EXEMPLARY EMBODIMENTS

Figure 7:
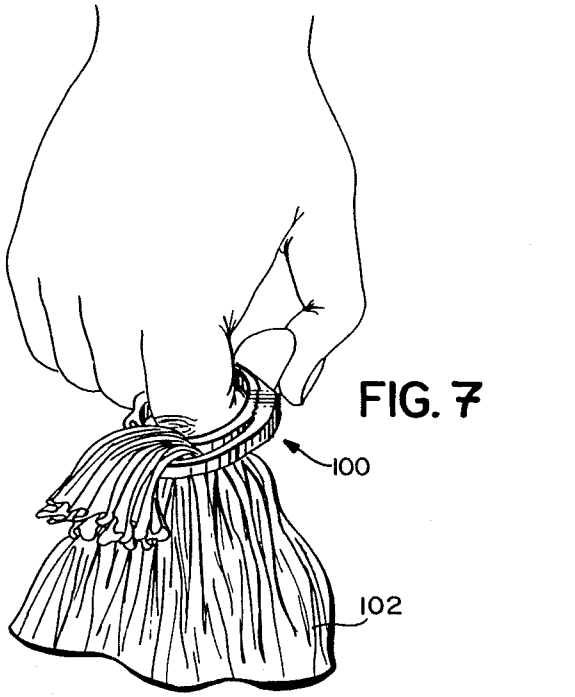
FIG. 7 is a perspective view of another embodiment of a bag closure device of this invention shown in its closed position.

One preferred embodiment of a bag closure device 10 according to the present invention is shown in accompanying FIGS. 1 and 2, which respectively depict the device 10 in a closed and opened condition. As is seen particularly in FIG. 1, when the device 10 is in a closed position, a flexible bag 12 will be captured, and hence closed, between the device's handle member 14 and its clasp member 16.

The handle member 14 is generally comprised of an upper annular portion 18 and a generally V-shaped lower portion 20. The lower portion 20 of handle member 14 includes a pair of opposing sides 22, 24 which diverge outwardly from a bottom 26 towards the upper handle member portion 18. The sides 22, 24 and bottom 26 thus collectively define a truncated V-shape, with the bottom 26 establishing a bearing surface 27.

The clasp member 16 itself includes a pair of opposing sides 30, 32 which diverge outwardly from their juncture 33 so as to also be V-shaped in configuration. It will be observed that the V-shape of the clasp member 16 closely conforms to the V-shape of sides 22 and 24 of lower handle portion 20 so that the sides 22, 30 and 24, 32 of lower handle portion 20 and clasp member 16, respectively, will be adjacent to one another when the device 10 is in its closed condition (i.e., as shown in FIG. 1).

One end **16*a* of the clasp member 16 is joined to the handle member 14 so as to allow for relative pivotal movements therebetween (arrow 34 in FIG. 2), and thus permit the device 10 to be manually manipulated to assume its closed and opened conditions. Preferably, the handle and clasp members 14 and 16, respectively, are formed as a one-piece structure from any suitable resilient, yet shape-retaining material (e.g., a plastics material). Integral connection between the handle and clasp members 14 and 16, respectively, is most conveniently achieved by means of a hinge 36 formed by a region of reduced material thickness where the end 16*a* of clasp member 16 is joined to the handle member 14. Preferably, the hinge 36 is formed at the location where the lower and upper handle portions 20 and 18, respectively, meet. Of course, the clasp member 16 and handle member 14** may be formed as separate elements and then joined by any suitable hinge means.

The other end **16*b* of clasp member 16 terminates in a generally transverse latch flange 38 which engages a ledge surface 40 formed in the handle member 14 as perhaps is best seen in accompanying FIG. 3. With the device 10 in a closed condition (i.e., when the handle and clasp members 14, 16, respectively, are adjacent one another as shown in FIG. 1), the interior end 38*a* of latch flange 38 will be retained and supported by means of the ledge surface 40. The exterior end 38*b* of the latch flange 38 may, however, be yieldably pivoted (arrow 42 in FIG. 3) so as to facilitate disengagement of the end 39*a* and ledge surface 40 (and hence the uncoupling of the clasp and handle members 16, 14, respectively). The ledge surface 40 is preferably formed at a position in the handle member 14 where the side 22 of its lower portion 20 meets its upper portion 18. Thus, the ledge surface 40 is generally diametrically opposed to the hinge 36 which joins the end 16*a* of clasp member 16 to the handle member 14**.

In use, a top of a flexible bag 12 is gathered and placed in the V-shaped trough formed at the juncture 33 of sides 30 and 32 of clasp member 16. The handle member 14 and/or the clasp member 16 may then be pivoted towards one another (arrow 34 in FIG. 2) until the end 38*a* of latch flange 38 is engaged With the ledge surface 40 of the handle member 14, at which time the device 10 is in its closed condition (i.e., as is shown in FIG. 1). It will be appreciated that, when in its closed condition, the bearing surface 27 of the bottom 26 associated with the lower handle portion 20 will compress that portion of the flexible bag which occupies the V-shaped trough against the interior surface of juncture 33 and/or the interior surfaces of sides 30, 32. This compression of the bag 12 thus effectively captures the same between the surface 27 and the clasp member 16.

While in its closed position with the bag 12 captured between the lower handle portion 20 and the clasp member 16 as described above, the device 10/bag 12 may then be transported by a user simply grasping the handle portion 14 and moving it to a desired location. It will be appreciated that the device 10 will thereby support the bag 12 during its transport. And, owing to the functional cooperation between the V-shaped trough of clasp member 16 and the surface 27 of lower handle portion 20, the weight of the bag 12 will not cause it to slip from its gripped relationship with the device 10 during transport. The weight of the bag 12 will actually beneficially tend to encourage the latch flange 38 and the ledge surface 40 to be drawn together tightly since the opposite sides 22 and 24 of the lower handle portion 20 will resiliently collapse inwardly somewhat under the bag's weight.

When it is desired to open the device 10 so as to release its captured relationship with the bag 12, a user need only apply a force against latch flange 38 so as to resiliently pivot it in the direction of arrow 42 in FIG. 3 away from its engagement with the ledge surface 40. Thereafter, the handle member 14 and/or the clasp member 16 may be pivoted away from each other about the hinge 36 (i.e., in a direction opposite to arrow 34 shown in FIG. 2) so that the bag 12 may be removed from the V-shaped trough of the clasp member 16.

When the device 10 is employed by a manufacturer to seal the contents of the bag 12, a tamper-evident stake 44 may be formed integrally with side 22. Thus, the stake 44 will penetrate through an aperture 46 defined in the side 30 of clasp member 16 when the device is in its closed condition, with the terminal end of stake 44 preferably being heat-sealed to the side 30. Any damage to this heat seal will thus be evidence that the contents of bag 12 may have been altered or have been tampered with. The stake 44 need not be heat sealed to side 30 of clasp member 16, however. That is, stake 44, when registered with aperture 46, will serve to prevent lateral slippage from occurring as between the handle and clasp members 14, 16, respectively, and thereby minimize (if not preclude) inadvertent disengagement and uncoupling thereof.

Figure 5:
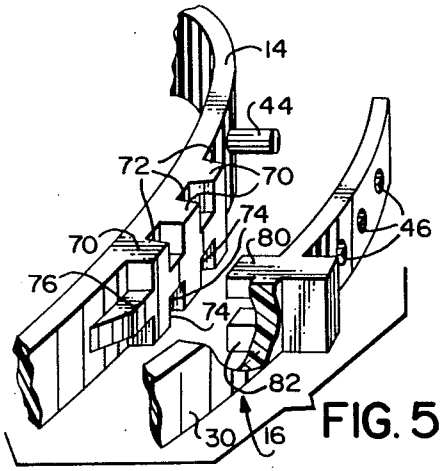
Figure 4:
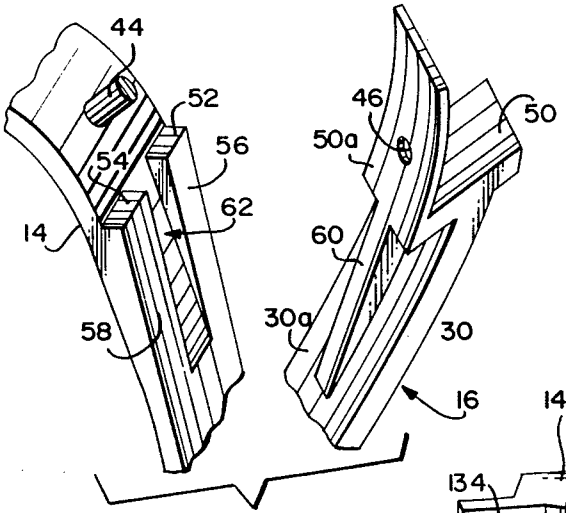

Alternate means for removably coupling the handle and clasp members 14, 16, respectively, one to the other are shown in accompanying FIGS. 4 and 5. The coupling means shown in FIG. 4 includes a latch flange 50 generally transverse to the side 30 of clasp member 16. A pair of ledge surfaces 52, 54 are defined at respective terminal ends of elongate bosses 56, 58 so as to support end 50*a* of latch flange 50 when it is engaged therewith. An elongate tongue 62 extends downwardly from the latch flange 50 along the interior surface 30*a* of side 30 and mates with a corresponding groove 62 defined between the bosses 56 and 58 when the latch flange end 50*a* is engaged with the ledge surfaces 52, 54. The mated tongue 62 and groove 60 thereby prevent lateral slippage between the latch flange 50 and the ledge surfaces 52, 54, and hence at least minimizes the risk of inadvertent uncoupling between the handle and clasp members 14 and 16, respectively.

The coupling means shown in accompanying FIG. 5 includes a plurality of transverse bosses 70 protruding from an exterior side of the handle member 14, each defining paired ledge surfaces 72 and 74 separated by a longitudinally extending tongue 76. A latch flange 78 is provided at the terminal end of side 30 of clasp member 16 and includes a pair of finger members 80, 82 in facing relationship to the transverse bosses 70 associated with the handle member 14. As is seen, finger members 80, 82 are each engageable with a respective pair of ledge surfaces 72, 74 with the tongue occupying the space defined between the finger members 80, 82. This structural cooperation thus couples the handle member 14 and clasp member 16 one to the other and allows for the amount of bag compression to be selected by the user in dependence upon the particular pair of ledge surfaces 72, 74 with which the finger members 80, 82 are engaged. As is apparent, the interengagement of the tongue 76 and the space defined between the finger members 80, 82 will prevent lateral slippage between the handle and clasp members 14, 16, respectively, and thus prevent inadvertent uncoupling thereof.

Figure 6:
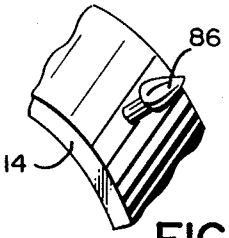
FIG. 6 is a detailed perspective view of a lock stake which may be used in combination with the coupling means o this invention.

The coupling means shown in FIGS. 4 and 5 may also include a tamper-evident stake 44 which will project through an aperture 46 defined in extensions 84. As before, the stake 44 may be heat sealed to the extensions 46 so as to provide evidence of possible tampering with the contents of bag 12. Alternatively, the stake may be in the form of an tab 86 having an enlarged head as is shown in FIG. 6 which is adapted to be press fit through through aperture 46. The tab 86 is particularly useful to provide repeated positive, yet releasable, "locking" as between the handle member 14 and the clasp member 16.

Figure 8:
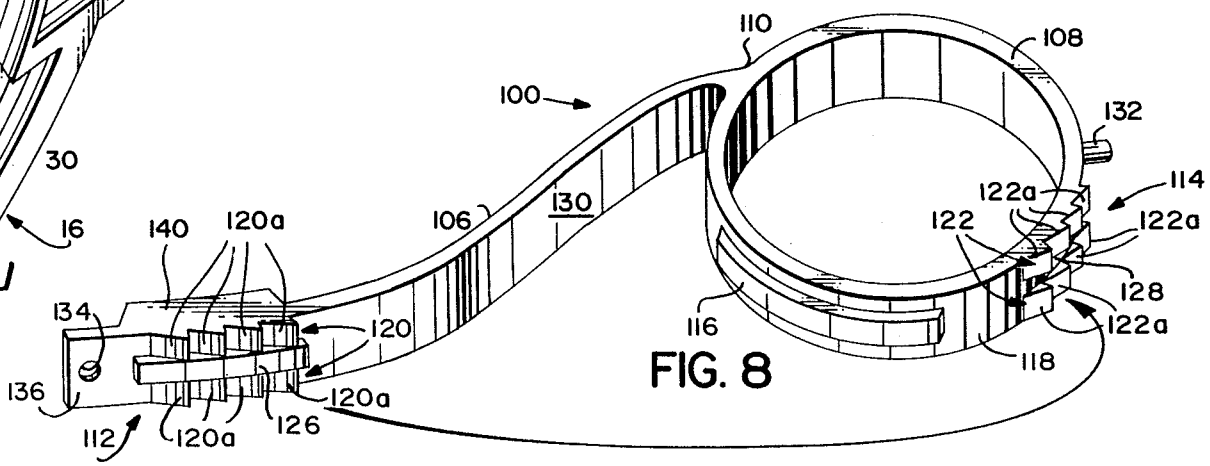
FIG. 8 is a perspective view of the bag closure device shown in FIG. 7, but depicted in an opened position.

Another preferred embodiment of a bag closure device 100 according to this invention is shown in accompanying FIGS. 7 and 8. Although the bag closure device 100 is shown as being sized and configured to accept a user's finger, it may be formed to any size depending, for example, upon the size of the bag 102 which it is intended to close.

As is perhaps more clearly seen in FIG. 8, the clasp of the bag closure device 100 is in the form of an axially flexible strap member 106 joined to an annular handle member 108 at hinge region 110. The end of strap member 106 opposite to its connection to handle member 108 at hinge region 110 is provided with one part 112 of a two-part coupling system. The other part 114 of the coupling system is provided integrally with the handle member 108 at generally a diametrically opposed location to hinge region 110. Between the hinge region 110 and the coupling part 114, the handle member 108 is provided with a circumferential boss segment 116 which protrudes from the exterior surface 118 of handle member 108.

Figure 11:
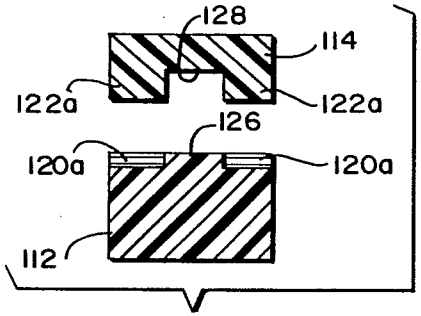
FIG. 11 is a cross-sectional elevational view of the coupling means shown in FIG. 10 as taken along line 11—11 therein.
Figure 10:
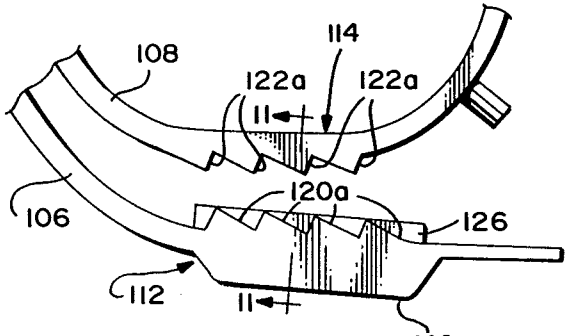
FIG. 10 is a detailed side elevational view similar to FIG. 9, but showing the preferred coupling means in an uncoupled relationship.
Figure 9:
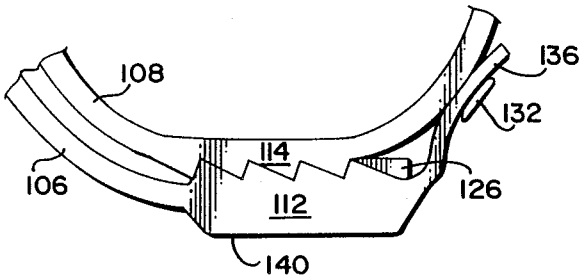
FIG. 9 is a detailed side elevational view of the preferred coupling means employed in the bag closure device shown in FIGS. 7 and 8.

The coupling parts 112 and 114 associated with the strap and handle members 106 and 108, respectively, are shown in their engaged and disengaged positions in accompanying FIGS. 9 and 10 (with FIG. 11 being a cross-sectional view taken along line 11—11 in FIG. 10). As is seen the coupling parts 112 and 114 each include a pair of generally parallel serrated members 120 and 122, each of which defines a series of teeth 120a, 122a, respectively. The serrated members 120 associated with the strap member 106 are separated by means of a protruding tongue 124, whereas the serrated members 122 associated with the handle member 106 are separated by a circumferentially extending groove 128 defined therebetween. When the strap member 106 is coupled to the handle member 108 (i.e., when the two parts 112 and 114 of the coupling system are engaged with one another as shown in FIG. 9), the tongue 126 and groove 128 will mate with one another thereby preventing lateral slippage from occurring as between the coupling parts 112 and 114, and hence minimize (if not preclude) inadvertent uncoupling thereof.

In use, a portion of a bag 102 (see FIG. 7) will be positioned adjacent the boss segment 116 of handle member 108, and the flexible strap 106 will be manipulated so that its coupling part 112 is in facing relationship to the coupling part 114 associated with handle member 108. As will be appreciated, this action causes the boss segment 116 to compress a region of the bag 102 against the inner surface 130 of strap member 106 thereby effectively capturing the compressed bag region therebetween. That is, since a portion of the bag 102 is compressed between the boss segment 116 and surface 130, it will be effectively captured thereby so that the weight of the bag 102 will not cause it to slip through the device 100 during transport.

Additional slip-prevention means may also be provided. For example, the interior surface 130 of strap 106 could be "roughened" to increase its friction coefficient. In addition (or alternatively), the boss segment 116 and/or a corresponding region of surface 130 could have a suitable friction material (e.g., an elastomer) bonded thereto.

The degree to which the bag 102 is compressed between boss segment 116 and surface 130 will depend, at least in part, upon the particular location at which the teeth 120a engage the teeth 122a. That is, since the teeth 122a are radially separated about the circumference of the handle member 108, by engaging a lowermost set of teeth 120a (i.e., those teeth located closest to the hinge region 110) with the uppermost teeth 122a (i.e., those teeth 122a located farthest from the boss segment 116), then a maximum amount of bag compression is achieved between the boss segment 116 and the surface 130. Conversely, if an uppermost set of teeth 120a (i.e., those teeth 120a located farthest from the hinge region 110) is engaged with the lowermost teeth 122a (i.e., those teeth 122a closest to the boss segment 116), a minimum amount of compression between the boss segment 116 and the surface 130 will be achieved.

Of course, in the embodiment shown a plurality of teeth 120a and 122a are provided so as to achieve degrees of bag compression intermediate the maximum and minimum discussed above. For example, a moderate amount of bag compression is achieved by positioning the teeth 120a and 122a in the manner shown in FIG. 9. Suffice it to say that the device 100 is capable of effectively capturing, and thus closing, a desired portion of the bag 102.

The bag closure device 100 will preferably include a stake 132 which will penetrate through the aperture 134 defined in an extension 136 of the strap 106. As mentioned briefly above with regard to the embodiment of this invention shown in FIGS. 1–2, the stake 132 may be heat sealed to the extension 136 (as is shown in FIG. 9) so as to provide evidence of tampering, for example. In addition, it is preferred that a thumb boss 140 protrude from the strap 106 in the region of coupling part 112 thereof so as to allow the user to more easily disengage coupling parts 112 and 114 when desired.

Figure 12:
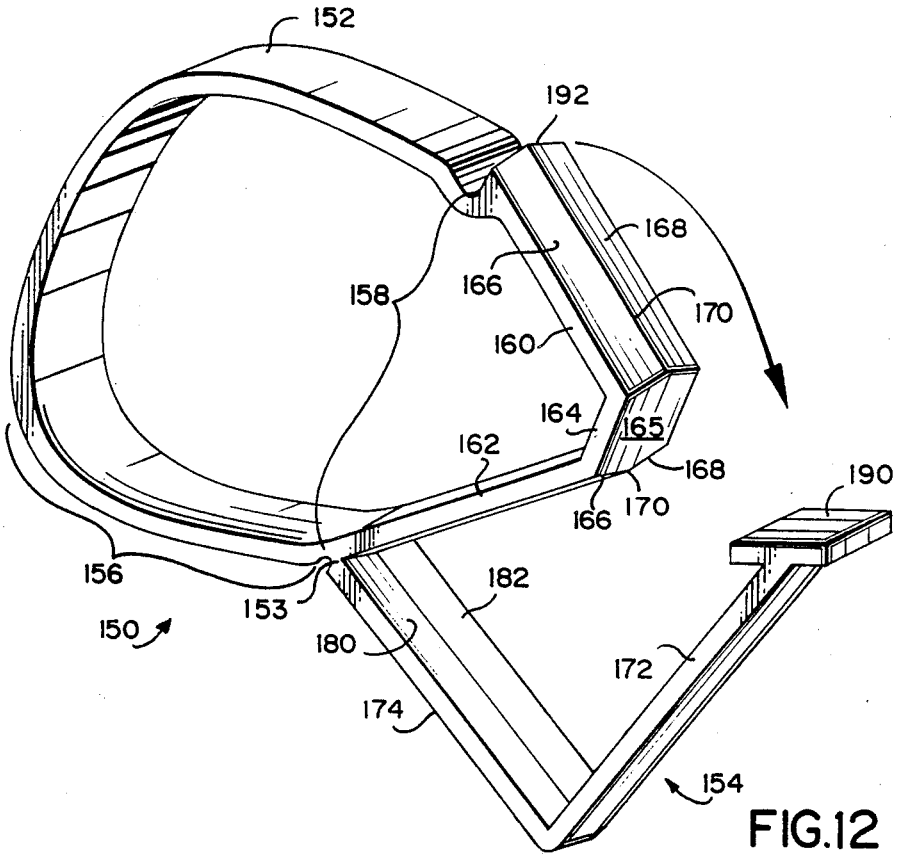
FIG. 12 is a perspective view of another embodiment of a bag closure device according to this invention shown in an opened state.
Figure 13:
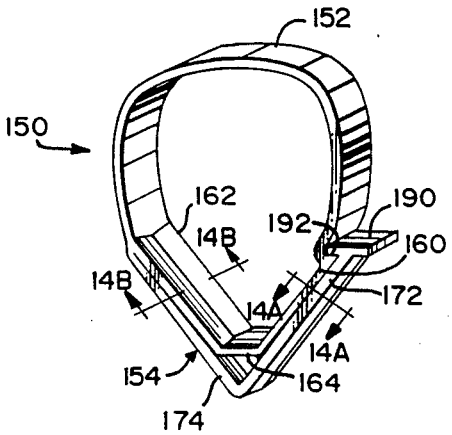
FIG. 13 is a smaller scale perspective view of the bag closure device shown in FIG. 12, but shown in a closed state.
Figure 13A:
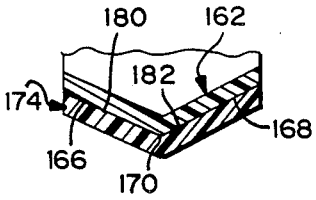
Figure 13B:
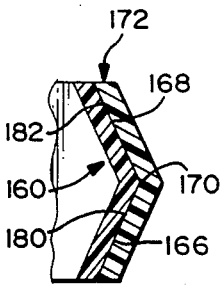
Figure 15:
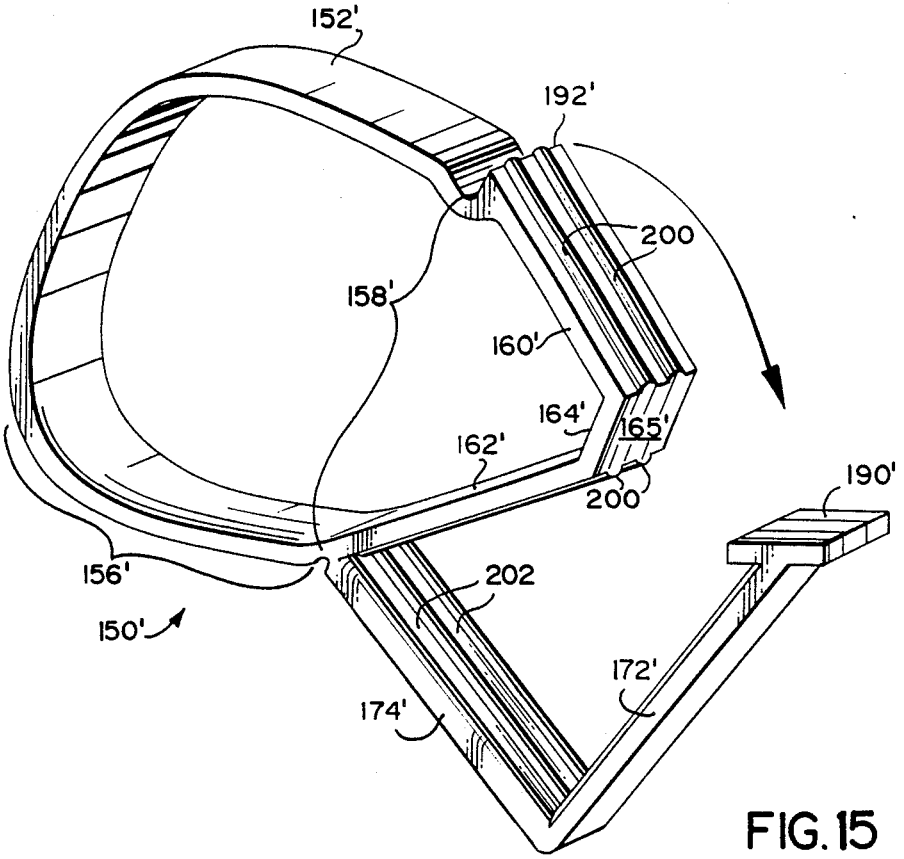
FIG. 15 is a perspective view of another embodiment of a bag closure device according to this invention shown in an opened state.
Figure 16:
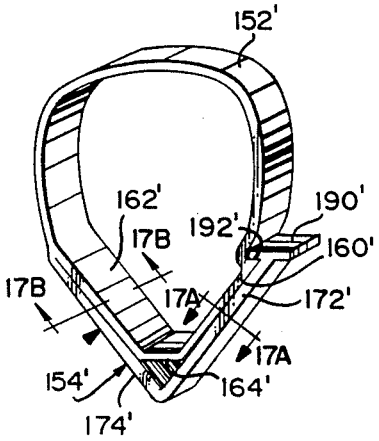
FIG. 16 is a smaller scale perspective view of the bag closure device shown in FIG. 15, but shown in a closed state.
Figure 17A:
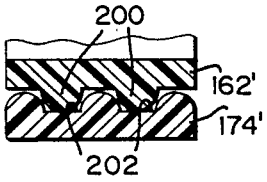
FIGS. 17A and 17B are each cross-sectional views taken along lines 17A—17A and 17B—17B in FIG. 16.
Figure 17B:
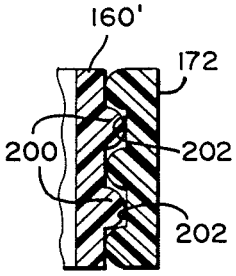

Another embodiment of a bag closure device 150 according to the present invention is shown in accompanying FIGS. 12 and 13. As is seen, the device 150 is similar to the device 10 described previously in that it includes a handle member 152 and a clasp member 154 joined at one of its ends to the handle member 152 via a flexible hinge member 153. The handle member is formed with an integral upper annular portion 156 and a generally V-shaped lower portion 158. The lower portion 156 of handle member 152 includes a pair of opposing sides 160, 162 which diverge outwardly from a bottom wall 164 towards the upper handle member portion 156. The sides 160, 162 and bottom wall 164 thus collectively define a truncated V-shape, with the bottom wall 164 establishing a bearing surface 165 to capture a bag therebetween when the device 150 is in a closed state (i.e., as shown in FIG. 13).

The sides 160, 162 are each formed with a pair of outside planar surfaces 166, 168 which extend along the linear extent of the sides 150, 162 from the bottom wall 164 towards the lower portion's 158 integral connection with the upper handle portion 152. Moreover, these surfaces 166, 168 diverge from one another from an apex 170 towards respective lateral edges of the sides 160, 162, thereby forming outwardly projecting V-shaped surfaces.

The clasp member 154 itself includes a pair of opposing sides 172, 174 which diverge outwardly from their juncture 175 so as to also be V-shaped in configuration. It will be observed that the V-shape of the clasp member 154 closely conforms to the V-shape of sides 160, 162 of lower handle portion 158 so that the sides 160, 162 and 172, 174 of lower handle portion 158 and clasp member 154, respectively, will be adjacent to one another when the device 150 is in its closed state.

Each of the opposing sides 172, 174 includes a pair of inside planar surfaces 180, 182 (only surfaces 180, 182 associated with side 174 being visible in FIG. 12; but see FIG. 14B) which extend along the linear extent of the sides 72, 74 and form respective V-shaped recessed troughs. These V-shaped troughs of the sides 72, 74 are thus sized and configured so as to accept the V-shaped sides 160, 162 (i.e., which V-shape is established by means of the planar surfaces 166, 168) when the clasp member 154 is closed (i.e., as is shown in FIG. 13). That is, as is seen in FIG. 14A, the surfaces 166, 168 associated with side 162 of lower handle portion 158 are in adjacent contact with the surfaces 180, 182, respectively, associated with side 174. Similarly as is shown in FIG. 14B, the surfaces 166, 168 associated with side 160 of lower handle portion 158 are in adjacent contact with the surfaces 180, 182, respectively, associated with side 172.

This mated relationship of the outwardly projecting V-shaped sides 160, 162 on the one hand, and the inwardly V-shaped recessed sides 172, 174, will thereby serve to minimize lateral slippage as between the clasp member 154 and the handle member 152 when the latch flange 190 is engaged with the ledge surface 192 formed in the handle member 152 (i.e., when the device 150 is in its closed state).

Alternative means for minimizing lateral slippage between the clasp member and the handle member of the bag closure devices according to this invention is shown in accompanying FIGS. 15–16 and 17A–17B. The device 150' shown in these FIGS. is similar to device 150 described above with reference to FIGS. 12–13, and thus like structures have been denoted by a prime (') reference numeral. Further discussion regarding such like structures will therefore not be repeated here.

The sides 160', 162' each include elongate ribs 200 which extend along the linear extent of the sides 160' and 162'. A pair of ribs 200 just happens to be shown in FIGS. 15, 17A and 17B, but it should be understood that a single rib 200, or more than a pair of ribs 200 could be provided to achieve equivalent functions. The sides 172', 174' each define a pair of recessed channels 202 extending along the linear extent of each.

With the clasp member 154' in a closed condition, the ribs 200 will each registerably be received within a respective one of the channels 102. This interlocking registration of the ribs 200 and channels 202 will thereby serve to minimize lateral slippage between the clasp member 154' and the handle member 152' when the device 150' is in a closed state.

Figure 18:
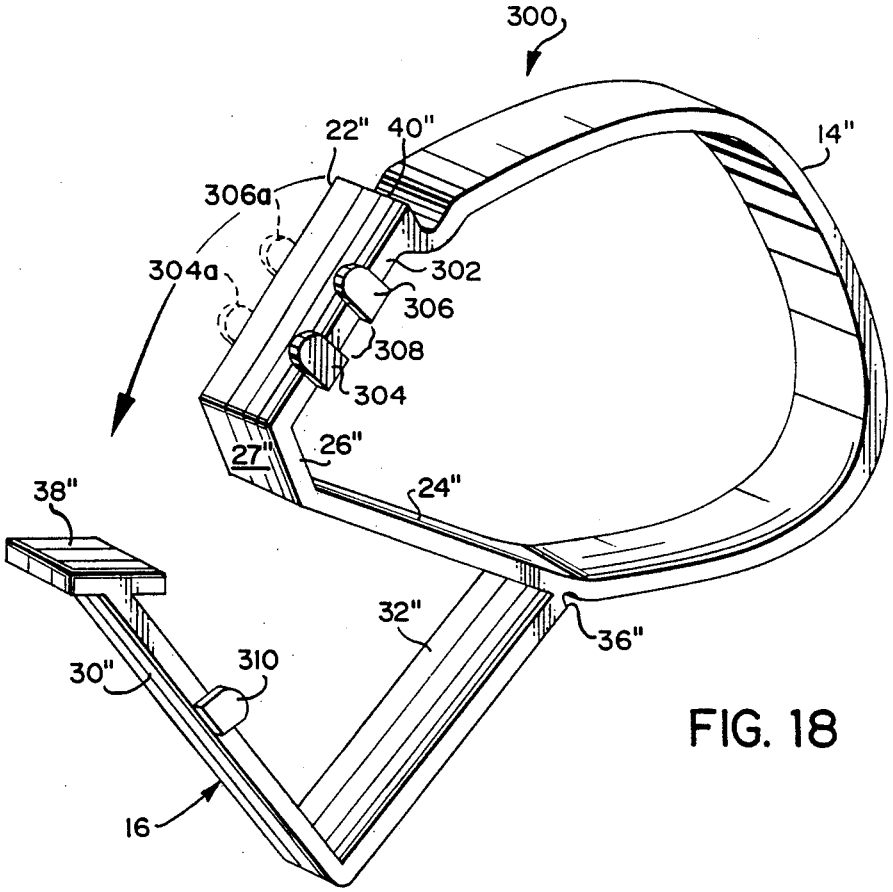
FIG. 18 is a perspective view of another embodiment of a bag closure device according to this invention shown in an opened state.
Figure 19:
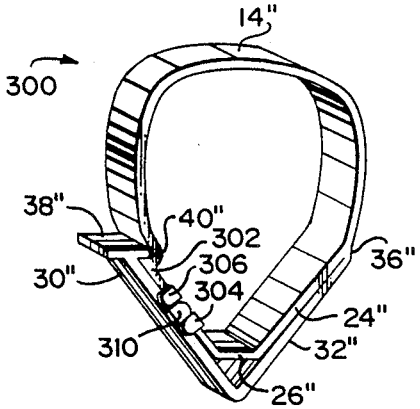
FIG. 19 a smaller scale perspective view of the bag closure device shown in FIG. 18, but shown in a closed state

The bag closure device 300 depicted in accompanying FIGS. 18 and 19 is yet another embodiment of means to minimize lateral slippage as between the clasp member 16'' and the handle member 14''. (Since most of the structures of device 300 are similar to those described above for the device 10 shown in FIGS. 1–2, such similar structures are noted by a double prime (") following the reference numerals and will not be described in further detail here.)

As is seen, a lateral edge 302 of side 22'' is provided with a pair of outwardly projecting and longitudinally spaced-apart retaining flanges 304, 306 which thereby define therebetween a space 308. The side 30'' of the clasp member 16'' is provided with a similar, but inwardly, projecting retaining flange 310 which is sized and configured to be accepted with the space 308 defined between the flanges 304, 306.

When the clasp member 16'' is pivoted into its closed position (i.e., as is shown in FIG. 19) the retaining flange 310 will be positioned between the spaced-apart flanges 304 and 306 and will abut against the lateral edge 302 of side 22''. This relative positioning of the flange 310 will thereby minimize lateral slippage of the side 30'' (and hence the clasp member 16'') relative to the handle member 14'' when the flange 38'' is seated on ledge 40''. In such a manner, a more secure closure of the device 300 may be provided.

Although the flanges 304 and 306 are depicted in FIG. 18 as being associated with side 22'' of handle member 14'', and flange 310 is shown as being associated with side 30'' of clasp member 16'', they could be reversed from that shown. That is, the flange 310 could be provided with side 22'' of handle member 14'' and the flanges 304 and 306 (e.g., as is shown in phantom line as 304 and 306 in FIG. 18) could be provided with the side 30'' of clasp member 16''. And, more than a single flange 310 and more than a pair of flanges 304, 306 could be provided so long as the flanges 310 on the one hand, and flanges 304, 306 on the other hand, are interdigitated when the clasp member 16'' is closed.

Thus, while the invention has been described in connection with what is presently considered to be the most practical and preferred embodiments, it is to be understood that the invention is not to be limited to the disclosed embodiments. On the contrary, the invention is intended to cover various modifications and equivalent arrangements included within the spirit and scope of the appended claims.

What is claimed is:

1. A bag closure device comprising:

a handle member;

a clasp member having one end joined to said handle member so as to allow for relative movements thereof between (i) an opened condition, wherein said clasp and handle members are separated from one another to permit removal and insertion of a bag portion therebetween, and (ii) a closed position, wherein said handle and clasp members are adjacent to one another so as to capture and thus close said bag portion therebetween; and coupling means collectively provided on the other end of said clasp member and on a corresponding region of said handle member for removably coupling said clasp and handle members to one another in said closed condition thereof, wherein, said coupling means includes;

(a) means defining plural paired transverse ledge surfaces spaced apart along an exterior of said handle member at said corresponding location of said handle member, and a latch flange having a pair of finger members associated with said other end of said clasp member and adapted to being engaged with, and supported by, selected ones of said defined pairs of ledge surfaces when said clasp and handle members are in said closed condition thereby removably coupling said clasp and handle members one to another; and (b) slip-preventing means for preventing relative lateral slippage of said coupling means to thereby substantially preclude uncoupling of said clasp and handle members by virtue of such relative slippage, said slip-preventing means including an elongate tongue element formed on one of said clasp and handle members, and an elongate groove formed on the other of said clasp and handle members in facing relationship to said tongue element when said clasp and handle members are in said closed condition, said tongue and groove mating with one another when said clasp and handle members are in said closed condition to prevent slippage therebetween laterally of said mated tongue and groove.

2. A bag closure device as in claim 1, wherein said slip-preventing means includes a stake extending from one of said clasp and handle members, and an aperture defined by the other of said clasp and handle members which receives said stake when said clasp and handle members are in said closed condition, whereby relative slippage therebetween is substantially precluded.

3. A bag closure device as in claim 1 or 2, wherein said tongue extends in the circumferential direction of said plural pairs of ledge surfaces substantially centrally located relative thereto, and said finger members of said latch flange define said groove therebetween which mates with said tongue.

4. A bag closure device comprising:

a handle member;

a clasp member having one end joined to said handle member so as to allow for relative movements thereof between (i) an opened condition, wherein said clasp and handle members are separated from one another to permit removal and insertion of a bag portion therebetween, and (ii) a closed position, wherein said handle and clasp members are adjacent to one another so as to capture and thus close said bag portion therebetween; and coupling means collectively provided on the other end of said clasp member and on a corresponding region of said handle member for removably coupling said clasp and handle members to one another in said closed condition thereof, wherein, said coupling means includes;

(a) slip-preventing means for preventing relative lateral slippage of said coupling means to thereby substantially preclude uncoupling of said clasp and handle member by virtue of such relative slippage, said slip-preventing means including an elongate tongue element formed on one of said clasp and handle member, and an elongate groove formed on the other of said clasp and handle members in facing relationship to said tongue element when said clasp and handle members are in said closed condition, said tongue and groove mating with one another when said clasp and handle members are in said closed condition to prevent slippage therebetween laterally of said mated tongue and groove; and (b) means defining a pair of ledge surfaces on said handle member at said corresponding region thereof and laterally separated by means of said groove, and a latch flange associated with said other end of said clasp member and adapted to being engaged with, and supported by, said defined pair of ledge surfaces when said clasp and handle members are in said closed condition thereby removably coupling said clasp and handle members one to another, and wherein (c) said tongue is formed below said latch flange so that said tongue and groove are mated when said latch flange is engaged with said pair of laterally separated ledge surfaces.

5. A bag closure device as in claim 1 or 4, wherein, said handle member includes an upper annular handle portion, and an integral lower V-shaped handle portion having a truncated bottom, and said clasp member is generally V-shaped in conformance to said V-shaped lower handle portion, said truncated bottom of said V-shaped lower handle portion and said V-shaped clasp member establishing a space therebetween when said clasp and handle members are in said closed condition for accepting said bag portion therewithin, said truncated bottom compressing said bag portion against said V-shaped clasp member so as to capture the same therebetween when said clasp and handle members are in said closed condition.

6. A bag closure device as in claim 5, wherein said slip-preventing means includes a stake extending from one of said clasp and handle members, and an aperture defined by the other of said clasp and handle members which receives said stake when said clasp and handle members are in said closed condition.

7. A bag closure device as in claim 6, wherein said stake includes an enlarged head portion.

8. A bag closure device comprising:

an annular handle member which includes an upper handle portion which terminates in a pair of terminal ends, and a V-shaped lower handle portion which includes a bottom wall, and a pair of side walls which collectively establish a circumferential segment of said annular handle member, said bottom wall forming a truncated bottom of said V-shaped lower handle portion, and each said side wall having one end integral with said bottom wall and an opposite end integral with a respective terminal end of said upper handle portion, said side walls outwardly diverging from one another from said one ends to said opposite ends thereof;

a V-shaped clasp member conforming to said V-shaped lower handle portion;

hinge means for hingedly connecting one end of said clasp member to said handle member to allow for relative pivotal movements between a closed condition such that said V-shaped clasp member is circumferentially adjacent an exterior of said V-shaped lower handle portion, and an opened condition wherein said V-shaped clasp member and said V-shaped handle portion are separated from one another; and coupling means for removably coupling the other end of said clasp member to said handle member, whereby a portion of a bag is captured, and thus closed, therebetween.

9. A bag closure device as in claim 8, further comprising slip-preventing means for preventing relative lateral slippage of said coupling means to thereby substantially preclude uncoupling of said clasp and handle members by virtue of such relative slippage.

10. A bag closure device as in claim 9, wherein said slip-preventing means includes a stake extending from one of said clasp and handle members, and an aperture defined by the other of said clasp and handle members which receives said stake when said clasp and handle members are in said closed condition, whereby relative slippage therebetween is substantially precluded.

11. A bag closure device as in claim 9, wherein, (a) said coupling means includes;

means defining at least one generally transverse ledge surface at said corresponding location of said handle member;

a latch flange associated with said other end of said clasp member and adapted to being engaged with, and supported by, said defined ledge surface when said clasp and handle members are in said closed condition thereby removably coupling said clasp and handle members one to another; and wherein, (b) said slip-preventing means includes;

an elongate tongue element formed on one of said clasp and handle members; and an elongate groove formed on the other of said clasp and handle members in facing relationship to said tongue element when said clasp and handle members are in said closed condition, said tongue element and said groove mating with one another when said clasp and handle members are in said closed condition to prevent slippage therebetween laterally of said mated tongue element and groove.

12. A bag closure device as in claim 8, further comprising means for minimizing relative lateral slippage between said clasp member and said lower handle portion when said clasp member is in said closed condition thereof, said means for minimizing relative lateral slippage including:

means defining a first pair of planar surfaces on an exterior perimetrical extent of said lower handle portion joined to one another so as to be V-shaped in cross-section such that an apex along which said pair of planar surfaces is joined extends outwardly from said handle member; and means defining a second pair of planar surfaces on said clasp member which conform to said first pair of planar surfaces.

13. A bag closure device as in claim 8, further comprising means for minimizing relative lateral slippage between said clasp member and said lower handle portion when said clasp member is in said closed condition thereof, said means for minimizing relative lateral slippage including:

a number of ribs laterally separated from one another and extending along a selected circumferential extent of one of said clasp member and said lower handle portion; and a number of recessed channels formed in the other of said clasp member and said lower handle portion and adapted to receive a corresponding one of said ribs therein when said clasp member is in said closed condition.

14. A bag closure device as in claim 8, further comprising means for minimizing relative lateral slippage between said clasp member and said lower handle portion when said clasp member is in said closed condition thereof, said means for minimizing relative lateral slippage including:

at least one pair of circumferentially spaced-apart flanges formed on a lateral edge of one of said handle and clasp members; and at least one retaining flange formed on a lateral edge of the other of said handle and clasp members, said retaining flange being located along said lateral edge of said other member and being of a size such that it is positioned between said spaced-apart flanges and bears against said lateral edge of said one member when said clasp member is in said closed condition.

15. A bag closure device comprising:

an annular handle member which includes a V-shaped lower portion terminating in a truncated bottom;

a V-shaped clasp member conforming to said V-shaped lower handle portion;

hinge means for hingedly connecting one end of said clasp member to said handle member to allow for relative pivotal movements between a closed condition wherein said V-shaped clasp member and said V-shaped lower handle portion are mateably adjacent one another, and an opened condition wherein said V-shaped clasp member and said V-shaped handle portion are separated from one another;

coupling means for removably coupling the other end of said clasp member to said handle member, whereby a portion of a bag is captured, and thus closed, therebetween; and slip-preventing means for preventing relative lateral slippage of said coupling means to thereby substantially preclude uncoupling of said clasp and handle members by virtue of such relative slippage; wherein said coupling means includes;

means defining plural paired ledge surface spaced apart along an exterior of said handle member at said corresponding location thereof; and a latch flange having a pair of finger members associated with said other end of said clasp member and adapted to being engaged with, and supported by, a selected one of said defined paired ledge surfaces when said clasp and handle members are in said closed condition thereby removably coupling said clasp and handle members one to another; and wherein;

said slip-preventing means includes;

an elongate tongue element formed on one of said clasp and handle member; and an elongate groove formed on the other of said clasp and handle members in facing relationship to said tongue element when said clasp and handle members are in said closed condition;

said tongue element and said groove mating with one another when said clasp and handle members are in said closed condition to prevent slippage therebetween laterally of said mated tongue element and groove.

16. A bag closure device as in claim 15, wherein said tongue element extends in the circumferential direction of said plural pairs of ledge surfaces substantially centrally located relative thereto, and said finger members of said latch flange define said groove therebetween which mates with said tongue.

17. A bag closure device comprising:

an annular handle member which includes a V-shaped lower portion terminating in a truncated bottom;

a V-shaped clasp member conforming to said V-shaped lower handle portion;

hinge means for hingedly connecting one end of said clasp member to said handle member to allow for relative pivotal movements between a closed condition wherein said V-shaped clasp member and said V-shaped lower handle portion are mateably adjacent one another, and an opened condition wherein said V-shaped clasp member and said V-shaped handle portion are separated from one another;

coupling means for removably coupling the other end of said clasp member to said handle member, whereby a portion of a bag is captured, and thus closed, therebetween; and slip-preventing means for preventing relative lateral slippage of said coupling means to thereby substantially preclude uncoupling of said clasp and handle members by virtue of such relative slippage; wherein said slip-preventing means includes;

an elongate tongue element formed on one of said clasp and handle members; and an elongate groove formed on the other of said clasp and handle members in facing relationship to said tongue element when said clasp and handle members are in said closed condition;

said tongue element and said groove mating with one another when said clasp and handle members are in said closed condition to prevent slippage therebetween laterally of said mated tongue element and groove; and wherein said coupling means includes;

means defining a pair of ledge surfaces at said corresponding location on said handle member and laterally separated by means of said groove;

a latch flange associated with said other end of said clasp member and adapted to being engaged with, and supported by, said defined ledge surface when said clasp and handle members are in said closed condition thereby removably coupling said clasp and handle embers one to another; and wherein;

said tongue element is formed below said latch flange so that said tongue element and groove are mated when said latch flange is engaged with said pari of laterally separated ledge surfaces.

18. A bag closure device comprising:

an annular handle member which includes a V-shaped lower portion terminating in a truncated bottom;

a V-shaped clasp member conforming to said V-shaped lower handle portion;

hinge means for hingedly connecting one end of said clasp member to said handle member to allow for relative pivotal movements between a closed condition wherein said V-shaped clasp member and said V-shaped lower handle portion are mateably adjacent one another, and an opened condition wherein said V-shaped clasp member and said V-shaped handle portion are separated from one another;

coupling means for removably coupling the other end of said clasp member to said handle member, whereby a portion of a bag is captured, and thus closed, therebetween; and slip-preventing means for preventing relative lateral slippage of said coupling means to thereby substantially preclude uncoupling of said clasp and handle members by virtue of such relative slippage; wherein said coupling means includes;

means defining at least one generally transverse ledge surface at said corresponding location of said handle member;

a latch flange associated with said other end of said clasp member and adapted to being engaged with, and supported by, said defined ledge surface when said clasp and handle members are in said closed condition thereby removably coupling said clasp and handle embers one to another; and wherein;

said slip-preventing means includes;

an elongate tongue element formed on one of said clasp and handle members; and an elongate groove formed on the other of said clasp and handle members in facing relationship to said tongue element when said clasp and handle members are in said closed condition;

said tongue element and said groove mating with one another when said clasp and handle members are in said closed condition to prevent slippage therebetween laterally of said mated tongue element and groove; and a stake extending from one of said clasp and handle members, and an aperture defined by the other of said clasp and handle members which receives said stake when said clasp and handle members are in said closed condition.

19. A bag closure device as in claim 18, wherein said latch flange includes an extension member, said aperture being defined by means of said extension member, and wherein said stake extends from said handle member in registry with said defined aperture when said clasp and handle members are in said closed condition.

20. A bag closure device comprising:

a generally annular handle member;

a flexible strap member having one end connected to said handle member at a location which allows said strap member to be moved into a closed condition with said handle member such that said strap member is in an adjacent relationship to a circumferential portion of an exterior facing surface of said handle member;

coupling means for coupling the other end of said strap member to said handle member and thus maintaining said strap and handle members in said closed condition, wherein a flexible bag is captured, and thus closed, between said strap and handle members while in their said closed condition; and a circumferential boss segment extending from said circumferential exterior facing surface portion of said handle member, said boss segment providing means for facilitating the compression of said bag against said strap member when said strap and handle members are removably coupled to one another in said closed condition.

21. A bag closure device as in claim 20, further comprising slip-preventing means for preventing relative lateral slippage of said coupling means to thereby substantially preclude uncoupling of said strap and handle members by virtue of such relative slippage.

22. A bag closure device comprising:

a generally annular handle member;

a flexible strap member having one end connected to said handle member at a location which allows said strap member to be moved into a closed condition with said handle member such that said strap member is in an adjacent relationship to a circumferential portion of an exterior facing surface of said handle member;

coupling means for coupling the other end of said strap member to said handle member and thus maintaining said strap and handle members in said closed condition, wherein a flexible bag is captured, and thus closed, between said strap and handle members while in their said closed condition; and slip-preventing means for preventing relative lateral slippage of said coupling means to thereby substantially preclude uncoupling of said strap and handle members by virtue of such relative slippage, wherein (a) said coupling means includes;

means defining at least one generally transverse ledge surface at a location of said handle member adjacent said other end of said strap member when said strap and handle members are in said closed condition;

a latch flange associated with said other end of said strap member and adapted to being engaged with, and supported by, said defined ledge surface when said strap and handle members are in said closed condition thereby removably coupling said strap and handle members one to another; and wherein, (b) said slip-preventing means includes;

an elongate tongue element formed on one of said strap and handle members; and an elongate groove formed on the other of said strap and handle members in facing relationship to said tongue element when said strap and handle members are in said closed condition, said tongue element and groove mating with one another when said strap and handle members are in said closed condition to prevent slippage therebetween laterally of said mated tongue and groove.

23. A bag closure device as in claim 22, wherein, said ledge surface defining means defines plural paired ledge surfaces circumferentially spaced apart along an exterior of said handle member, and said latch flange includes a pair of finger members engageable with a selected one of said pair of ledge surfaces so as to removably couple said strap and handle members one to the other.

24. A bag closure device as in claim 23, wherein said tongue extends in the circumferential direction of said plural pairs of ledge surfaces substantially centrally located relative thereto, and said finger members of said latch flange define said groove therebetween which mates with said tongue.

25. A bag closure device as in claim 22, wherein said ledge surface defining means defines a pair of ledge surfaces on said handle member laterally separated by means of said groove, and said tongue is formed below said latch flange so that said tongue and groove are mated when said latch flange is engaged with said pair of laterally separated ledge surfaces.

26. A bag closure device comprising:

a generally annular handle member;

a flexible strap member having one end connected to said handle member at a location which allows said strap member to be moved into a closed condition with said handle member such that said strap member is in an adjacent relationship to a circumferential portion of an exterior facing surface of said handle member;

coupling means for coupling the other end of said strap member to said handle member and thus maintaining said strap and handle members in said closed condition, wherein a flexible bag is captured, and thus closed, between said strap and handle members while in their said closed condition; and slip-preventing means for preventing relative lateral slippage of said coupling means to thereby substantially preclude uncoupling of said strap and handle members by virtue of such relative slippage, wherein said coupling means includes (a) plural paired ledge surfaces circumferentially spaced apart along an exterior of said handle member, and (b) plural paired teeth formed on said other end of said strap member and engageable with a selected pair of ledge surfaces when said strap and handle member are in said closed condition.

27. A bag closure device as in claim 26, wherein said plural paired ledge surfaces are each laterally separated by a circumferentially extending groove, and said plural paired teeth are laterally separated by an elongate tongue element which mates with said groove when said strap and handle members are in said closed condition, whereby said mated tongue element and groove collectively establish said slip-preventing means.

28. A bag closure device comprising:

an annular handle member including an upper segment integral with a lower generally V-shaped segment, said upper and lower segments collectively establishing a circumferential extent of said handle member;

a generally V-shaped clasp member conforming to said generally V-shaped lower segment of said annular handle member;

hinge means for hingedly connecting one end of said clasp member to said handle member to allow for relative pivotal movements thereof between a closed condition such that said V-shaped clasp member is circumferentially adjacent an exterior of said V-shaped lower segment of said annular handle member for closing a bag therebetween, and an opened condition wherein said clasp member and said V-shaped lower segment of said annular handle member are separated from one another; and coupling means for removably coupling said clasp member to said annular handle member when in said closed condition thereof.

29. A bag closure device as in claim 28, wherein said coupling means includes a ledge surface associated with said annular handle member, and a latch flange associated with an end of said clasp member opposite to said one end thereof, said latch flange bearing against said ledge surface so as to removably couple said clasp member in said closed condition thereof to said handle member.

30. A bag closure device as in claim 29, wherein said generally V-shaped lower segment includes a bottom wall which defines a space collectively with said clasp in said closed condition thereof for accepting a portion of a bag to be closed therewithin, and a pair of side walls which outwardly diverge from said bottom wall, said side walls being formed of a resilient material which provides means which allow said side walls to resiliently collapse inwardly towards one another under the weight of a bag closed thereby, to thereby responsively cause said latch flange to bear against said ledge surface.

31. A bag closure device comprising:

a generally annular handle member;

a clasp member having one end joined to said handle member at a location which allows said clasp member to be moved pivotally into a closed condition with said handle member such that said clasp member is in an adjacent relationship to a circumferential portion of an exterior facing surface of said handle member; and means for minimizing relative lateral slippage as between said handle member and said clasp member when said clasp member is in said closed condition, said slippage minimizing means including;

(a) first surface-defining means defining at least one surface which projects from a selected circumferential segment of one of said handle and clasp member; and (b) second surface-defining means defining at least one recessed surface on a corresponding circumferential segment of the other of said handle and clasp members which is sized and configured to receive said at least one surface associated with said one of said handle and clasp members when said clasp member is in said closed position, wherein said handle member includes an upper circumferential segment and a lower, generally V-shaped circumferential segment, and wherein said clasp member is V-shaped so as to conform to, and be in an adjacent relationship with, said generally V-shaped lower circumferential segment of said handle member when said clasp member is in said closed condition.

32. A bag closure device as in claim 31, wherein said generally V-shaped lower circumferential segment of said handle member includes a truncated bottom thereby establishing a space between said truncated bottom and said V-shaped clasp member when said clasp member is in said closed condition, said truncated bottom providing means for compressing a portion of a bag within said defined space against said V-shaped clasp member so as to capture the same therebetween when said clasp member is in said closed condition.

33. A bag closure device as in claim 31, wherein said lower circumferential segment has at least one outwardly projecting V-shaped side, and said clasp member has an inwardly projecting V-shaped recess sized and configured to mate with said at least one outwardly projecting V-shaped side.

34. A bag closure device as in claim 31, wherein said first surface-defining means includes a number of ribs laterally separated from one another and extending along a selected circumferential extent of said one of said handle and clasp members, and said second surface-defining means includes a number of recessed channels formed in said other of said handle and clasp members and adapted to receive a corresponding one of said ribs therein when said clasp member is in said closed condition.

35. A bag closure device as in claim 34, wherein said number of ribs extend along a selected circumferential extent of said generally V-shaped lower circumferential segment of said handle member, and wherein said number of recessed channels are formed in said clasp member.

36. A bag closure device as in claim 31, further comprising coupling means for removably coupling said clasp and handle members when said clasp member is in said closed condition.

37. A bag closure device as in claim 36, wherein said coupling means includes:

means defining at least one generally transverse ledge surface at said location of said handle member;

a latch flange associated with another end of said clasp member, opposite said one end thereof, and adapted to being engaged with, and supported by, said defined ledge surface when said clasp member is in said closed condition thereby removably coupling said clasp and handle members one to another.

38. A bag closure device comprising:

a generally annular handle member having an upper circumferential segment and a lower, generally V-shaped circumferential segment;

a clasp member having one end joined to said handle member at a location which allows said clasp member to be moved pivotally into a closed condition with said handle member such that said clasp member is ian an adjacent relationship to a circumferential portion of an exterior facing surface of said handle member, said clasp member being V-shaped so as to conform to, and be in an adjacent relationship with, said generally V-shaped lower circumferential segment of said handle member when said clasp member is in said closed condition; and means for minimizing relative lateral slippage as between said handle member and said clasp member when said clasp member is in said closed condition, said slippage minimizing means including;

(a) first surface-defining means defining at least one surface which projects from a selected circumferential segment of one of said handle and clasp member; and (b) second surface-defining means defining at least one recessed surface on a corresponding circumferential segment of the other of said handle and clasp members which is sized and configured to receive said at least one surface associated with said one of said handle and clasp members when said clasp member is in said closed position, wherein said generally V-shaped lower circumferential segment of said handle member includes a truncated bottom thereby establishing a space between said truncated bottom and said V-shaped clasp member when said clasp member is in said closed condition, said truncated bottom providing means for compressing a portion of a bag within said defined space against said V-shaped clasp member so as to capture the same therebetween when said clasp member is in said closed condition; and wherein said first surface-defining means defines a pair of planar surfaces on an exterior perimetrical extent of said generally V-shaped lower circumferential portion joined to one another so as to be V-shaped in cross-section such that an apex along which said pair of planar surfaces is joined extends outwardly from said handle member.

39. A bag closure device as in claim 38, wherein said second surface-defining means includes a second pair of planar surfaces formed on said clasp member which conform to said first-mentioned pair of planar surfaces.

40. A bag closure device comprising:

a generally annular handle member;

a clasp member having one end joined to said handle member at a location which allows said clasp member to be moved pivotally into a closed condition with said handle member such that said clasp member is in an adjacent relationship to a circumferential portion of an exterior facing surface of said handle member; and means for minimizing lateral slippage as between said handle member and said clasp member when said clasp member is in said closed condition, said slippage minimizing means including;

(a) at least one pair of circumferentially spaced-apart flanges formed on a lateral edge of one of said handle and clasp members; and (b) at least one retaining flange formed on a lateral edge of the other of said handle and clasp members, said retaining flange being located along said lateral edge of said other member and being of a size such that said retaining flange is positioned between said spaced-apart flanges and bears against said lateral edge of said one member when said clasp member is in said closed condition.

41. A bag closure device as in claim 40, wherein said handle member includes an upper circumferential segment and a lower, generally V-shaped circumferential segment, and wherein said clasp member is V-shaped so as to conform to, and be in an adjacent relationship with, said generally V-shaped lower circumferential segment of said handle member when said clasp member is in said closed condition.

42. A bag closure device as in claim 41, wherein said generally V-shaped lower circumferential segment of said handle member includes a truncated bottom thereby establishing a space between said truncated bottom and said V-shaped clasp member when said clasp member is in said closed condition, said truncated bottom providing means for compressing a portion of a bag within said defined space against said V-shaped clasp member so as to capture the same therebetween when said clasp member is in said closed condition.

43. A bag closure device as in claim 40, further comprising coupling means for removably coupling said clasp and handle members when said clasp member is in said closed condition.

44. A bag closure device as in claim 43, wherein said coupling means includes:

means defining at least one generally transverse ledge surface at said corresponding location of said handle member;

a latch flange associated with said other end of said clasp member and adapted to being engaged with, and supported by, said defined ledge surface when said clasp member is said closed condition thereby removably coupling said clasp and handle members one to another.

* * * * *